United States Patent [19]

Abe

[11] Patent Number: 4,875,453

[45] Date of Patent: Oct. 24, 1989

[54] AIR-FUEL RATIO CONTROL SYSTEM FOR AN ENGINE

[75] Inventor: Kunihoro Abe, Higashimurayama, Japan

[73] Assignee: Fuji Jukogyo Kabushiki Kaisha, Tokyo, Japan

[21] Appl. No.: 170,441

[22] Filed: Mar. 18, 1988

[30] Foreign Application Priority Data

Mar. 23, 1987 [JP] Japan ..... 62-069563

[51] Int. Cl.[4] ..... F02M 39/00

[52] U.S. Cl. ..... 123/440; 123/488

[58] Field of Search ..... 123/440, 488, 494

[56] References Cited

U.S. PATENT DOCUMENTS

| | | | |
|---|---|---|---|
| 4,167,925 | 9/1979 | Hosaka | 123/440 |
| 4,291,659 | 9/1981 | Suzuki | 123/440 |
| 4,364,358 | 12/1982 | Shikata | 123/440 |
| 4,402,292 | 9/1983 | Ohgami | 123/440 |
| 4,402,293 | 9/1983 | Ohgami | 123/440 |
| 4,501,243 | 2/1985 | Nimi | 123/440 |
| 4,503,828 | 3/1985 | Ohgami | 123/440 |
| 4,556,033 | 12/1985 | Ito | 123/440 |
| 4,627,955 | 7/1987 | Takao | 123/440 |
| 4,651,695 | 3/1987 | Ohtaki | 123/440 |
| 4,767,520 | 8/1988 | Asakura | 123/440 |

FOREIGN PATENT DOCUMENTS

| | | | |
|---|---|---|---|
| 53-82927 | 7/1978 | Japan | 123/440 |

*Primary Examiner*—Carl Stuart Miller

*Attorney, Agent, or Firm*—Martin A. Farber

[57] ABSTRACT

An air-fuel ratio control system for an engine, has an $O_2$-sensor, an actuator for controlling air-fuel ratio of mixture, and a feedback control system responsive to the output of the $O_2$-sensor for operating the actuator thereby controlling the air-fuel ratio. The feedback control system includes a peak-to-peak voltage producing circuit for producing an upper peak value signal and a lower peak value signal, a reference value circuit responsive to the upper and lower peak value signals for providing a reference value, a comparator for comparing the output of the $O_2$-sensor with the reference value and for producing an error signal, and a driving circuit responsive to the error signal for operating the actuator. A limiter is provided between the $O_2$-sensor and the peak-to-peak voltage producing circuit for cutting a part of the voltage exceeding a predetermined level.

7 Claims, 7 Drawing Sheets

AIR-FUEL RATIO CONTROL SYSTEM FOR AN ENGINE

BACKGROUND OF THE INVENTION

The present invention relates to an air-fuel ratio control system for an engine for a motor vehicle, and more particularly to a system which appropriately controls additional air for a caruberator of the engine with a feedback control system.

Recently, an air-fuel ratio control system for an engine provided with a feedback control system has been proposed. In such a system, an exhaust gas sensor such as an $O_2$ sensor is provided for sensing the oxygen concentration of the exhaust gases to generate an electrical signal which is used for controlling the air fuel ratio of the fuel and air mixture.

FIGS. 5 to 9 show a conventional air-fuel ratio control system disclosed in Japanese Patent Application Laid-Open No. 53-82927.

As shown in FIG. 5, an $O_2$ sensor 2 provided in an exhaust passage 1 of the engine detects the oxygen concentration of the exhaust gases and produces an electrical signal which is applied to a buffer amplifier 3 for amplifying the signal. The amplified signal is applied to a peak-to-peak voltage providing circuit 5 (hereafter called P-P circuit) and an air fuel ratio control circuit 4. The P-P circuit 5 produces upper and lower peak voltages in the output of the amplifier 3, the output signals of which are applied to a reference value circuit 6. The circuit 6 produces a mean value of the peak voltages as a reference value for a desired air-fuel ratio of the air-fuel mixture. The output signal corresponding to the reference value is applied to the air fuel ratio control circuit 4 and compared with the output signal of the amplifier 3. The output signal of the control circuit 4 is supplied to an actuator driving circuit 7 for operating an actuator 8. The actuator 8 operates to actuate an air bleed control valve in a carburetor (not shown) for controlling the flow rate of intake air or to control the amount of fuel injected from a fuel injector.

In the system, since the reference value is determined based on the peak values of concentration of oxygen in the exhaust gases, the reference value does not change even if the output characteristic of the $O_2$ sensor 2 changes because of its deterioration with time. However, since the $O_2$ sensor 2 has a high internal resistance and is located near the engine, noise such as ignition noise from an ignition system is liable to affect the output of the $O_2$ sensor.

FIG. 6 shows an example of an electric circuit for the system of FIG. 5 and FIG. 7 shows waveforms showing characteristics of output signals of the circuit.

The $O_2$ sensor 2 produces an output signal $VO_2$ including alternate maximum peak values and minimum peak values in accordance with the variation of the oxygen concentration. If an abnormal high voltage signal Vnoise enters into the $O_2$ sensor 2, the $O_2$ sensor 2 produces a signal having a high voltage which is charged in a capacitor C1 of the P—P circuit 5 as a peak value Vpeak. High voltage at capacitor C1 continues until the higher peak voltage is discharged. In accordance with the higher peak voltage, the reference value circuit 6 produces a reference value Vs1 which is higher than a predetermined reference value Vs. The high reference value Vs1 is applied to an inverting input terminal of an operational amplifier OP1 of the air fuel ratio control circuit 4 and compared with the signal $VO_2$ applied to a non-inverting input terminal thereof. Accordingly, the amplifier OP1 produces an output signal which is greatly deviated from an ordinary value. The deviated signal is further applied to a non-inverting input terminal of a comparator OP2 and compared with a triangular wave pulse train from an oscillator 12 to produce a square wave pulse train. The square wave pulse train operates to turn on-off a transistor Tr. Thus, the actuator 8 is intermittently operated at an abnormal duty ratio. Accordingly, an improper amount of intake air is supplied, thereby reducing exhaust emission control.

As shown in FIG. 8, the Japanese patent application further discloses a system in which the reference value circuit 6 has a minimum value limiter 16 comprising a diode D1, and resistors R1, R2, and a maximum value limiter 17 comprising a diode D2, and resistors R3, R4. When the reference value exceeds a predetermined maximum value or a predetermined minimum value, either of the diodes D1, D2 is forward-biased to limit the reference value to the maximum value or the minimum value.

As shown in FIG. 9, when a higher peak voltage Vpeak is applied to the reference value circuit 6, the maximum value limiter 17 operates to limit the peak value to the maximum value VsLimit which is higher than the predetermined reference value Vs. The maximum value VsLimit is used as the reference value. However, the maximum value continues until the higher peak voltage charged in the capacitor C1 is discharged and gradually approaches the reference value as shown by a line Vs1. Accordingly, afore-mentioned defects cannot be removed by the system.

SUMMARY OF THE INVENTION

The object of the present invention is to provide an air fuel ratio control system which may provide a substantially constant reference value.

The other objects and features of this invention will become understood from the following description with reference to the accompanying drawings.

DETAILED DESCRIPTION OF THE PREFERRED EMBODIMENT

Figure 1:
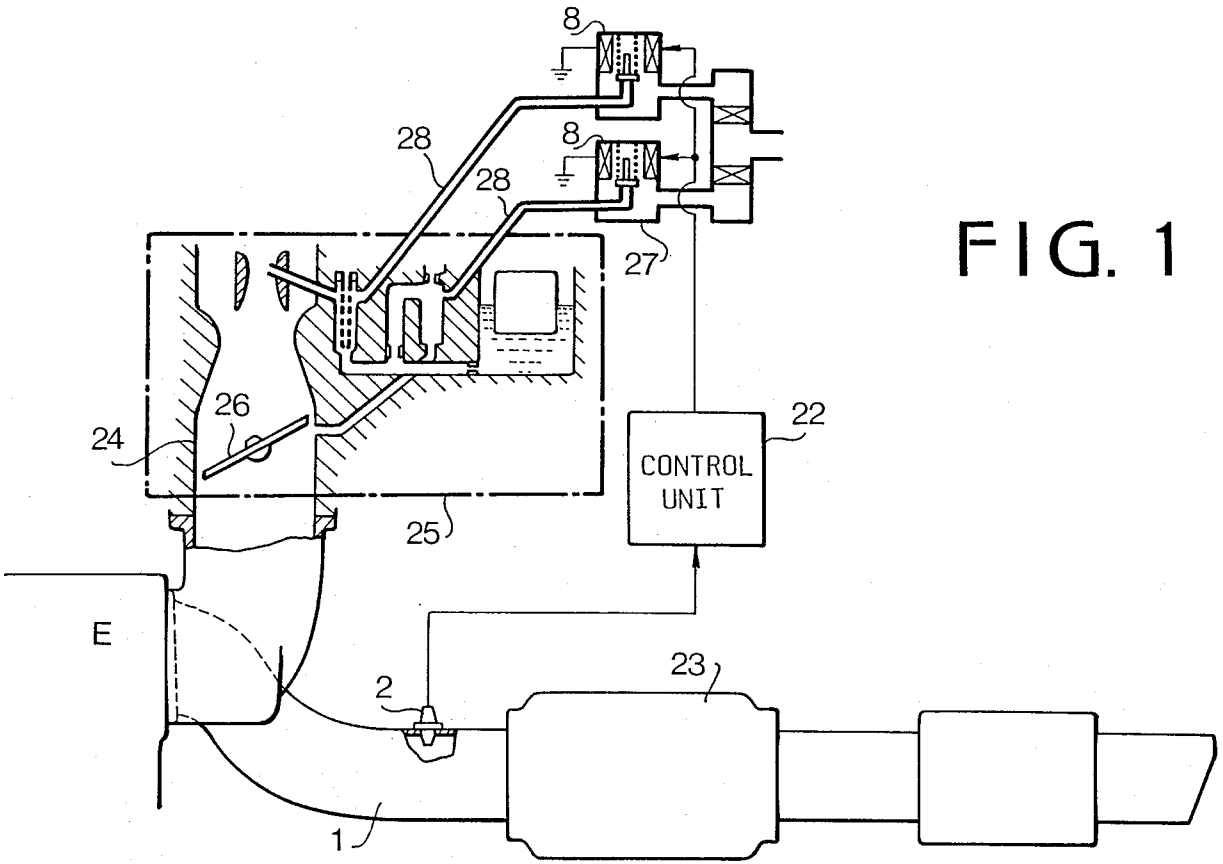
FIG. 1 is a schematic diagram showing an air fuel ratio control system to which the present invention is applied.

Referring to FIG. 1 showing an air fuel ratio control system of the present invention, in an intake passage 24 having a throttle valve 26, an electrically controlled carburetor 25 is provided upstream of an engine E. Additional air supply passages 28 are provided in the carburetor 25 to atmosphere through on-off control valves 27 operated by actuators 8. An $O_2$ sensor 2 and a catalytic converter 23 are provided in an exhaust passage 1 of the engine E. The $O_2$ sensor 2 is provided for detecting the oxygen concentration in the exhaust gases in the exhaust passage 1. An output signal of the $O_2$ sensor is applied to a feedback control circuit 22. The control circuit 22 produces an output signal for operating the actuator 8.

Figure 2:
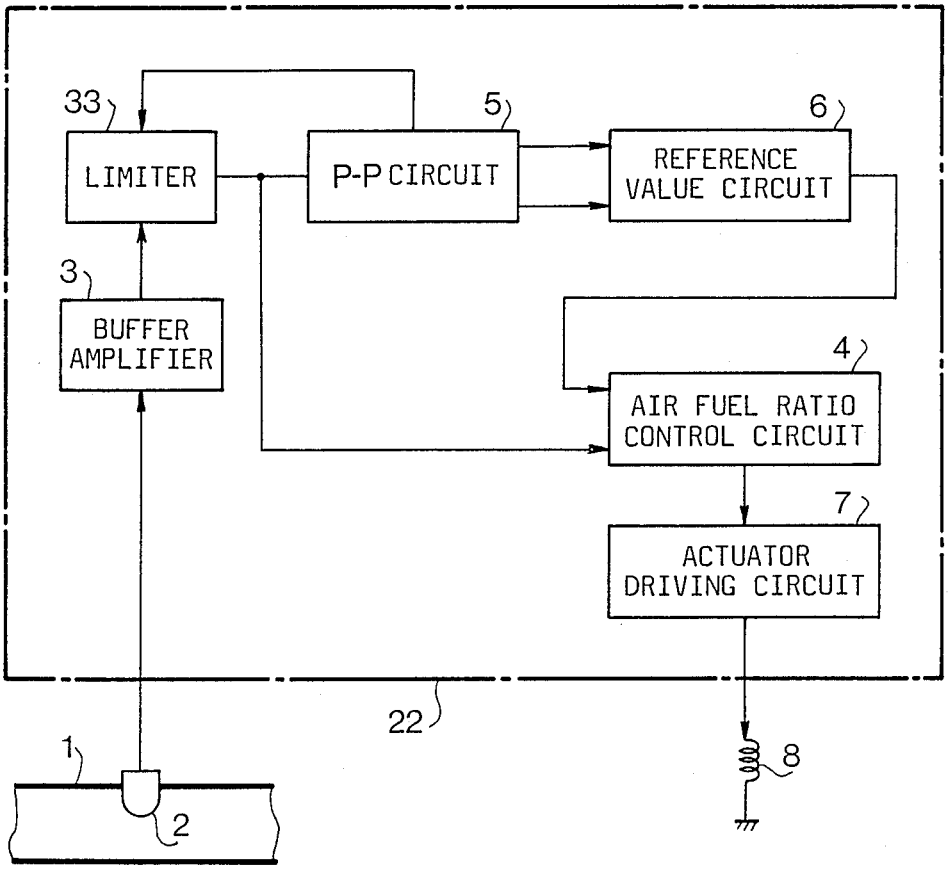
FIG. 2 is a block diagram showing a control circuit of the system.

Referring to FIG. 2, the control circuit 22 comprises the buffer amplifier 3 for amplifying the output signal from the $O_2$ sensor 2, P—P circuit 5 for producing a lower (minimum) peak value and an upper (maximum) peak value of the output signal of the $O_2$ sensor, reference value circuit 6 for producing the reference value for controlling the air fuel ratio, air-fuel ratio control circuit 4 for comparing the output signal of the $O_2$ sensor with the reference value, and actuator driving circuit 7 for driving the actuator 8.

In accordance with the present invention, the control circuit 22 has a limiter 33 provided between the buffer amplifier 3 and the P—P circuit 5. The limiter 33 is provided for limiting the level of the input voltage of the P—P circuit 5.

Figure 3:
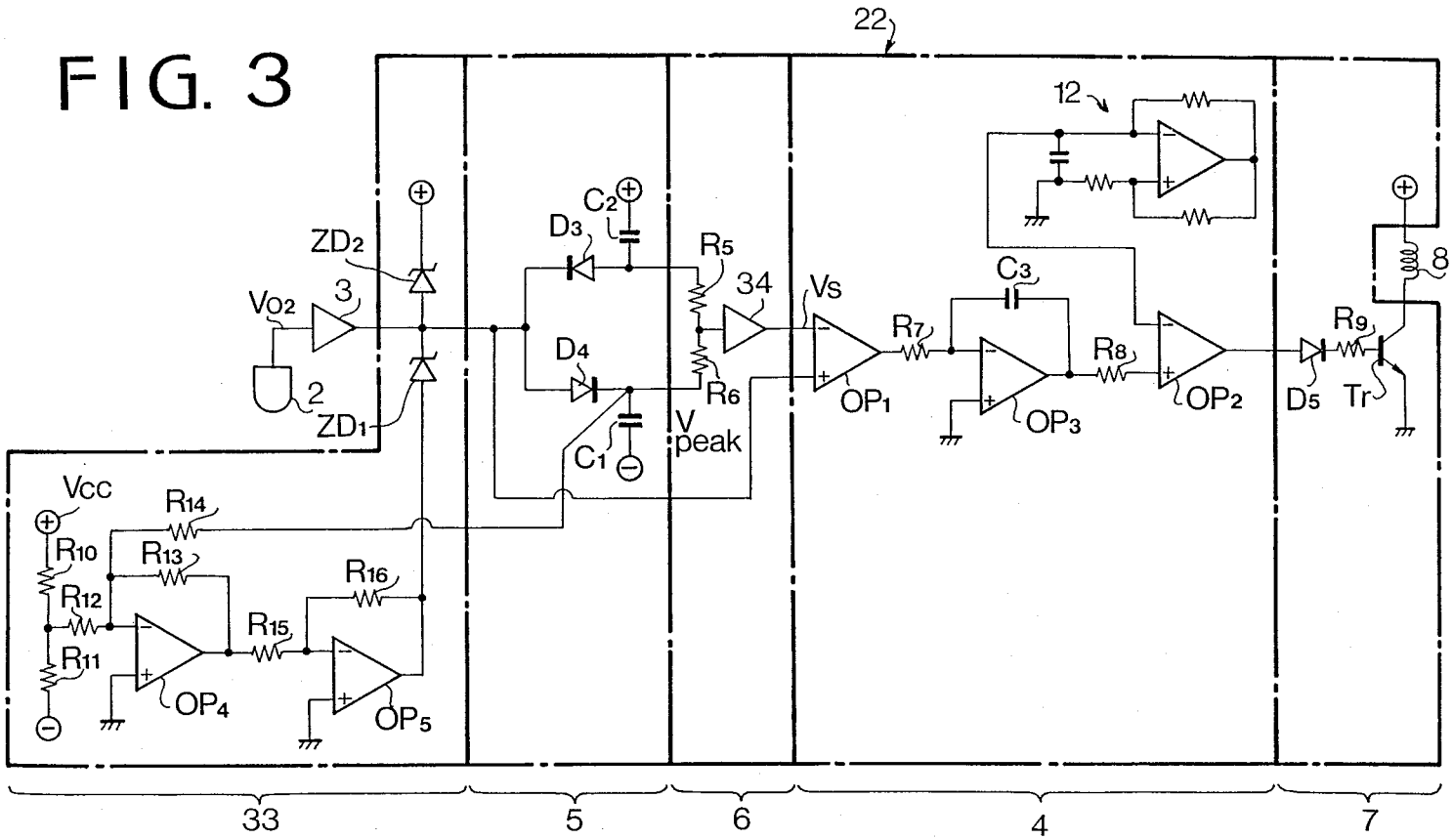
FIG. 3 is an electric circuit of the control circuit of FIG. 2.

Referring to FIG. 3 showing an electric circuit of the control circuit 22, the P—P circuit 5 comprises diodes D3 and D4 connected in parallel, the capacitor C1 connected to a negative supply source, and a capacitor C2 connected to a positive supply source. A cathode of the diode D3 is connected to an anode of the diode D4, to which the output signal $VO_2$ of the $O_2$ sensor is applied therebetween through the buffer amplifier 3. A cathode of the diode D4 is connected to an anode of the diode D3 through resistors R6 and R5 of the reference value circuit 6. The capacitor C2 is provided for charging the lower peak value of the signal $VO_2$ and connected between the anode of the diode D3 and the resistor R5. The capacitor C1 for storing the higher peak value of the signal $VO_2$ is connected between the cathode of the diode D4 and the resistor R6.

The voltage between the resistors R5, R6 is applied to the comparator OP1 at the inverting input terminal of the air fuel ratio control circuit 4 through a buffer amplifier 34. A non-inverting input terminal of the comparator OP1 is applied with the output signal $VO_2$ from the $O_2$ sensor 2. The control circuit 4 further comprises an integrator OP3 connected to an output terminal of the comparator OP1 at an inverting input terminal through a resistor R7, a comparator OP2 connected to an output terminal of the integrator OP3 at a non-inverting input terminal through a resistor R8. An output of an oscillator 12 as a triangular wave pulse generator is connected to the comparator OP2 at an inverting input terminal. A capacitor C3 is connected in parallel between the inverting input terminal and output terminal of the integrator OP3. A non-inverting input terminal of the integrator OP3 is connected to the ground. An output signal of the comparator OP2 is applied to a base of the transistor Tr of the actuator driving circuit 7 through a diode D5 and a resistor R9. A collector of the transistor Tr is connected to the actuator 8 and an emitter is connected to the ground.

The limiter 33 according to the present invention comprises an adder OP4, an inverting amplifier OP5 connected to the adder OP4 through a resistor R15, a zener diode (regulate diode) ZD1 for limiting a maximum value of the voltage $VO_2$, a zener diode ZD2 connected to the zener diode ZD1 in series for limiting a minimum value of the voltage $VO_2$, and resistors, R10, R11, R12, R13, R14, R16. Supply voltage Vcc is divided by resistors R10 and R11 and the divided voltage is applied to an inverting input terminal of the adder OP4 through the resistor R12. A non-inverting input terminal thereof is connected to the ground. The output of the adder OP4 is applied to an inverting input terminal of the inverting amplifier OP5 and to the inverting input terminal of the adder OP4 through the resistor R13. A non-inverting input terminal of the inverting amplifier OP5 is connected to the ground. The output terminal of the inverting amplifier OP5 is connected to an anode of the zener diode ZD1 and to the inverting input terminal of the inverting amplifier OP5 through the resistor R16. A cathode of the zener diode ZD1 is connected to an anode of the zener diode ZD2 and a cathode of the zener diode ZD2 is connected to a positive supply source. The amplified voltage $VO_2$ is applied between the zener diodes ZD1 and ZD2. To the inverting input terminal of the adder OP4, voltage at the capacitor C1 of the P—P circuit 5 is applied through the resistor R14.

In operation, when the engine starts, the $O_2$ sensor 2 produces the output signal $VO_2$ in accordance with the oxygen concentration of the exhaust gases. The voltage $VO_2$ varies alternately from the maximum value (rich mixture) to the minimum value (lean mixture) as shown in FIG. 4.

The voltage signal $VO_2$ is amplified at the buffer amplifier 3 and supplied to the P—P circuit 5 and to the control circuit 4. The voltage $VO_2$ is charged in or discharged from the capacitors C1 and C2 through the diodes D4 and D3. Thus, an upper peak voltage Vpeak is charged in the capacitor C1 and a lower peak voltage is charged in the capacitor C2. The charged voltages are discharged through the resistors R6, R5, so that subsequent voltages are charged in the capacitors. Both peak voltages are divided at a predetermined ratio (for example one half) by resistors R6, R5, thereby providing a reference value Vs which is amplified at the buffer amplifier 34. The reference value Vs is fed to the comparator OP1 and compared with the voltage $VO_2$. When the voltage $VO_2$ is higher than the reference value Vs, the comparator OP1 produces a higher voltage output as an error signal which is applied to the integrator OP3. The higher voltage is integrated and applied to the comparator OP2. The integrated voltage signal is compared with the triangular wave pulse train from the oscillator 12. When the integrated voltage is higher than the triangular wave pulse, the comparator OP2 produces a high-level voltage which is applied to the transistor Tr to turn on it. On the other hand, when the integrated signal is lower than the triangular wave pulse, a low-level voltage is produced to turn off the transistor Tr. The actuator 8 is intermittently operated in accordance with the turning on-off of the transistor Tr, for actuating the air bleed control valve 27.

In a normal operation, the adder OP4 of the limiter 33 is applied with the summations of the voltage $VO_2$ charged in the capacitor C1 and a predetermined voltage determined by the supply source Vcc at the inverting input terminal thereof. The adder OP4 supplies a negative voltage signal to the inverting amplifier OP5. The inverting amplifier OP5 supplies a positive voltage signal to the zener diode ZD1. The zener diode ZD1 operates to limit the voltage $VO_2$ to a maximum voltage $VO_2max$ (FIG. 4). The maximum voltage $VO_2max$ varies in accordance with the voltage charged in the capacitor C1.

Figure 4:
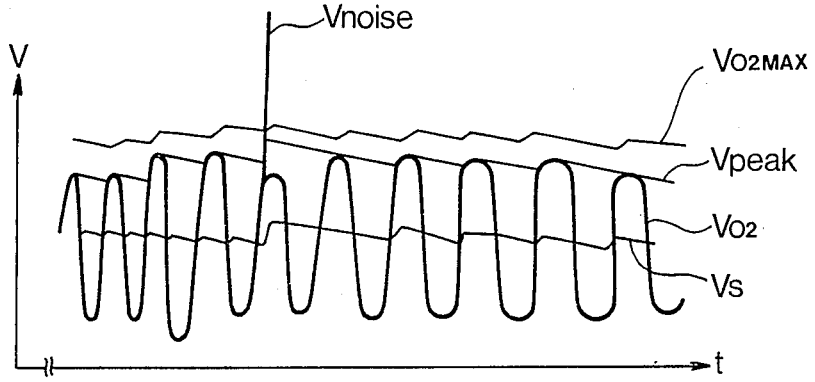
FIG. 4 shows waveform showing output signals at various positions of the system.
Figure 7:
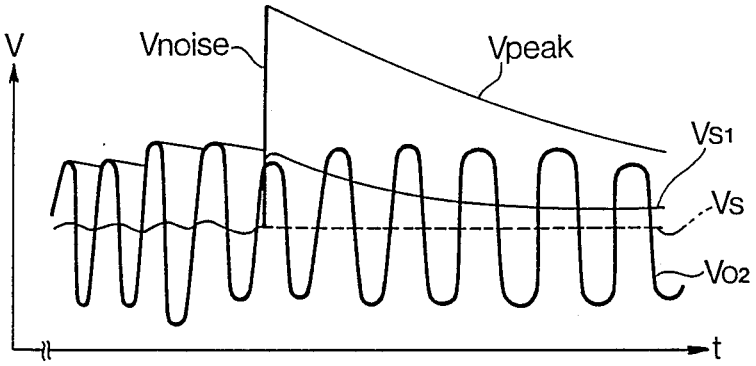
FIG. 7 shows waveforms showing output signals of the system of FIG. 6.
Figure 9:
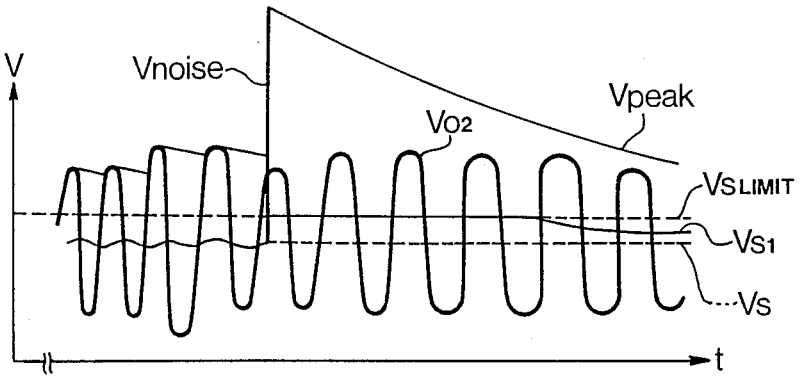
FIG. 9 shows waveforms showing output signals of the system of FIG. 8.
Figure 5:
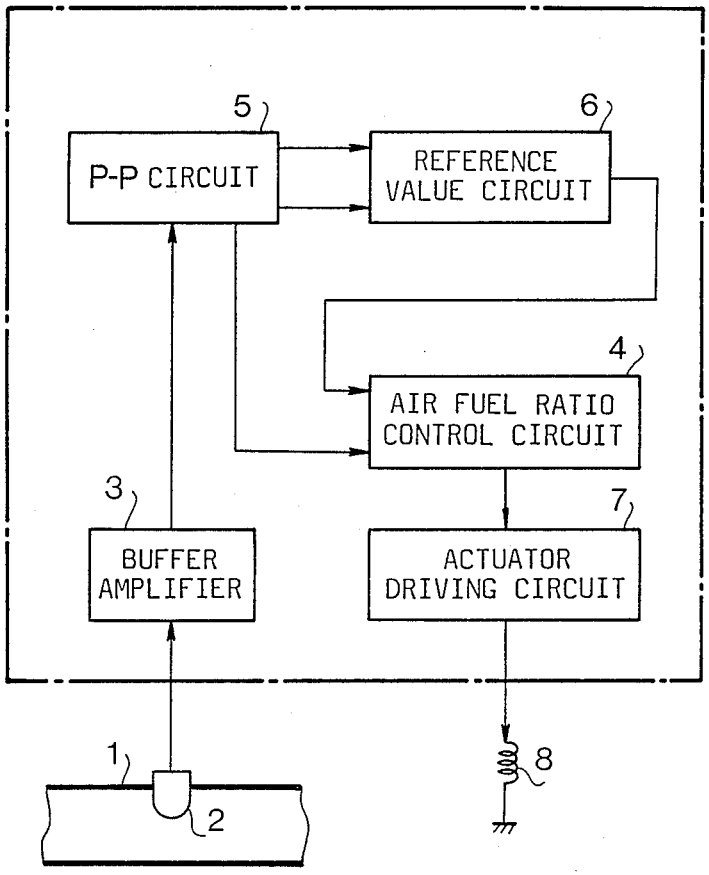
FIG. 5 is a block diagram showing a conventional air fuel ratio control system.
Figure 6:
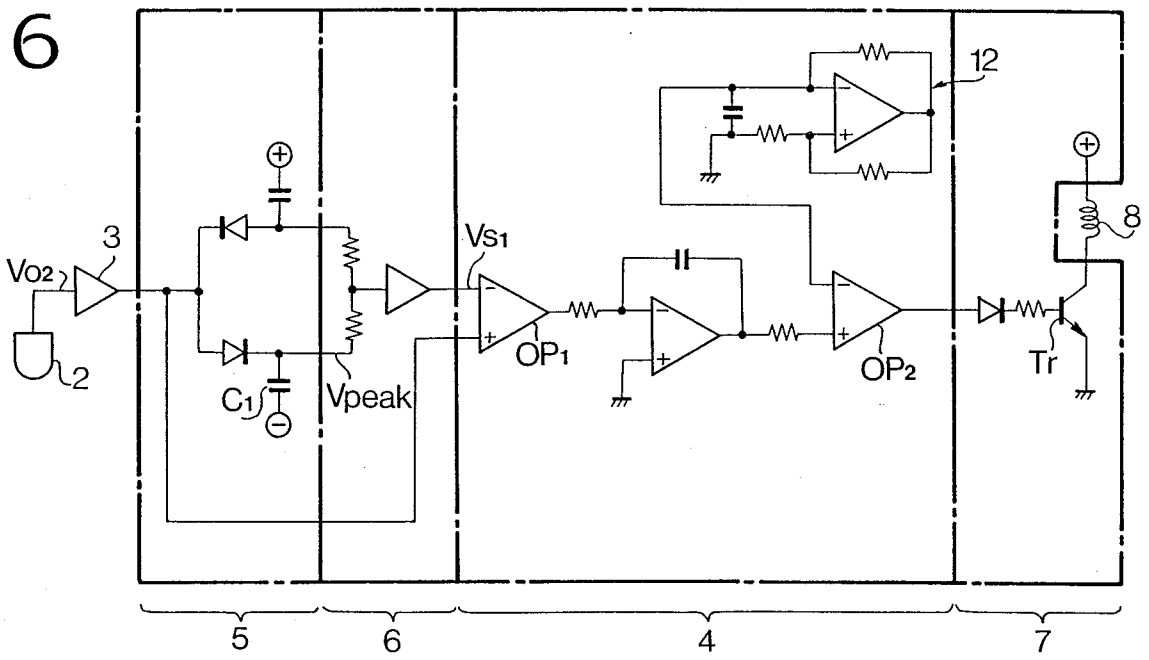
FIG. 6 is an electric circuit of the conventional system.
Figure 8:
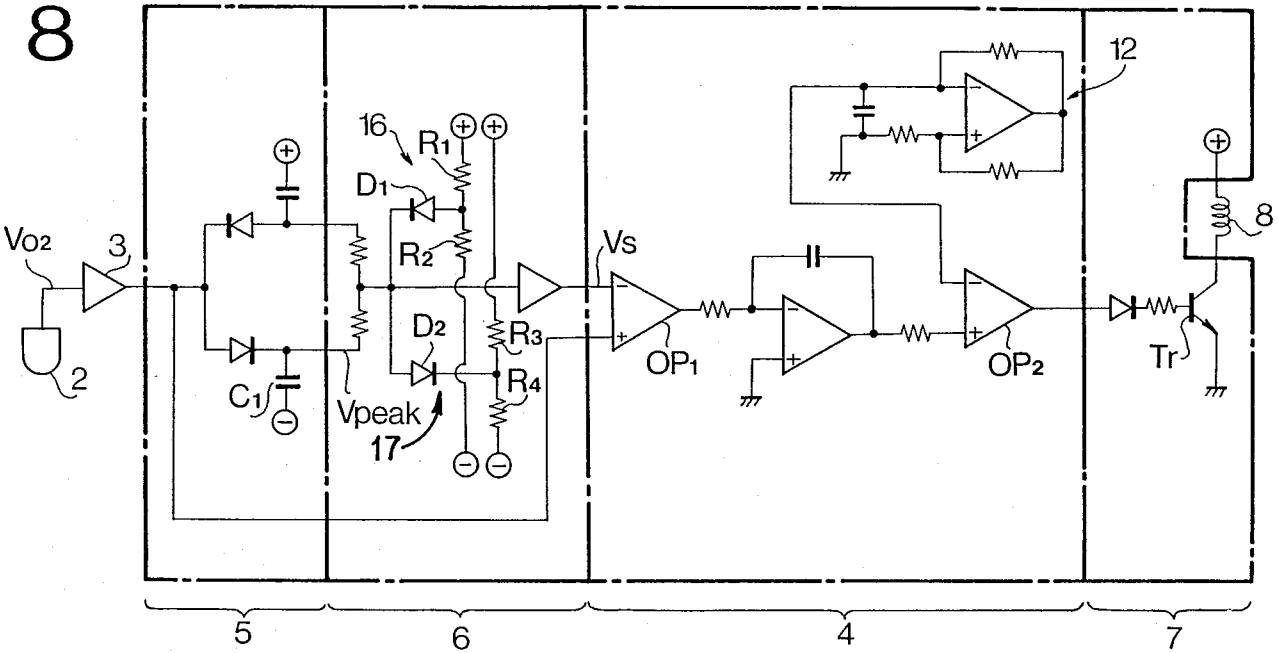
FIG. 8 is an electric circuit showing another example of the conventional system.

If noise enters into the $O_2$ sensor 2, the $O_2$ sensor 2 produces a high voltage Vnoise at a moment as shown in FIG. 4. The high voltage signal Vnoise is higher than the voltage ($VO_2max$) applied to the zener diode ZD1, so that the zener diode ZD1 is reverse-biased to cut off the voltage higher than the voltage ($VO_2max$). Accordingly, a peak voltage Vpeak which is slightly higher than a peak voltage before the noise is charged in the capacitor C1. Thus a reference value Vs close to the predetermined reference value is obtained at the reference value circuit 6.

Although the maximum peak voltage Vpeak charged in the capacitor C1 is slightly higher, it rapidly drops to a normal level, thereby preventing a large variation of the reference value Vs.

When the $O_2$ sensor 2 produces an abnormally low peak voltage $VO_2$, and it is lower than the voltage applied to the cathode of zener diode ZD2, the zener diode ZD2 is reverse-biased to cut off the lower part of the voltage.

In the present invention, if the output signal $VO_2$ decreases by deterioration in characteristic with time, the reference values Vs decreases accordingly to reduce the maximum peak voltage Vpeak. Since the maximum value $VO_2max$ at the zener diode ZD1 also decreases, the system is effectively operated to eliminate abnormality, for preventing deterioration of the system.

In accordance with the present invention, the system is provided with a limiter which is effectively operated irrespective of extreme output voltage from the $O_2$ sensor, thereby eliminating abnormality affecting the system. Thus, the air-fuel ratio of the mixture supplied to the engine or the amount of fuel injection is appropriately controlled, so that the exhaust emission control and the specific fuel consumption are improved.

While the presently preferred embodiment of the present invention has been shown and described, it is to be understood that this disclosure is for the purpose of illustration and that various changes and modifications may be made without departing from the spirit and scope of the invention as set forth in the appended claims.

What is claimed is:

1. In an air-fuel ratio control system for an engine, having an exhaust gas sensor for sensing concentration of content of exhaust gases of the engine providing an output of the exhaust gas sensor dependent on the concentration, an actuator for controlling air-fuel ratio of mixture to be supplied to the engine, a feedback control system responsive to the output of the exhaust gas sensor for operating the actuator to control the air-fuel ratio dependent on the output of the exhaust gas sensor, the feedback control system including peak value producing means for producing an upper peak value signal and representing an upper peak value a lower peak value signal, first reference value providing means responsive to the upper and lower peak value signals for providing a reference value, a comparator for comparing the output of the exhaust gas sensor with the reference value for producing an error signal, and a driving circuit responsive to the error signal for operating the actuator, the improvement in the air-fuel ratio control system comprising:

a limiter including a second reference value providing means for representing a maximum voltage which varies in accordance with the reference value and which is higher than the upper peak value, said reference value constituting a first reference value and said maximum voltage constituting a second reference value;

said limiter is provided between the exhaust gas sensor and the peak value producing means for cutting off a part of voltage exceeding said second reference value to prevent an abnormal voltage from entering the peak value producing means;

the limiter includes at least one zener diode connected to an input of the peak value producing means;

said zener diode is provided for reverse-biasing to cut off said voltage exceeding said second reference value; and said limiter preventing the upper peak value from exceeding said second reference value.

2. The air-fuel ratio control system according to claim 1, wherein said peak value producing means includes two diodes with an anode of one of said diodes connected to a cathode of the other of said diodes and capacitors respectively connected to the other cathode and anode of said diodes for producing the peak value signals, respectively, and said second reference value providing means comprises an adder having an input connected to one of said capacitors and to a fixed voltage.

3. The air-fuel ratio control system according to claim 2, wherein said limiter includes two of said at least one zener diode connected with an anode of one of said zener diodes connected to a cathode of the other of said zener diodes and an inverting amplifier connected to an output of said adder, said inverting amplifer has an output connected to the anode of said other zener diodes.

4. The air-fuel ratio control system according to claim 3, wherein said feedback control system further comprises a buffer amplifier connected to said exhaust gas sensor and to a junction between said zener diodes, said junction being connected to a junction between said two diodes of said peak value producing means and to an input of said comparator.

5. The air-fuel ratio control system according to claim 2, wherein said limiter includes two of said at least one zener diode with an anode of one of said zener diodes connected to a cathode of the other of said zener diodes, and said adder has an output operatively connected to the anode of said other of said zener diodes.

6. The air-fuel ratio control system according to claim 5, wherein said feedback control system further comprises a buffer amplifier connected to said exhaust gas sensor and to a junction between said zener diodes, said junction being connected to a junction between said two diodes of said peak value producing means and to an input of said comparator.

7. The air-fuel ratio control system according to claim 3, wherein said adder is an operational amplifier having another input connected to ground, and a feedback resistor connected between the first-mentioned input and said output of said adder.

* * * * *